United States Patent [19]

Jacobson

[11] Patent Number: 5,063,667

[45] Date of Patent: Nov. 12, 1991

[54] SHAVING SYSTEM

[75] Inventor: Chester F. Jacobson, Southboro, Mass.

[73] Assignee: The Gillette Company, Boston, Mass.

[21] Appl. No.: 589,673

[22] Filed: Sep. 28, 1990

[51] Int. Cl.[5] ..... B26B 19/44

[52] U.S. Cl. ..... 30/41; 30/50

[58] Field of Search ..... 30/41, 47–50, 30/86

[56] References Cited

U.S. PATENT DOCUMENTS 4,170,821 10/1979 Booth ..... 30/41
4,586,255 5/1986 Jacobson ..... 30/41
4,624,051 11/1986 Apprille ..... 30/41 X

FOREIGN PATENT DOCUMENTS 2024082 5/1982 United Kingdom .

*Primary Examiner*—Douglas D. Watts
*Attorney, Agent, or Firm*—Fish & Richardson

[57] ABSTRACT

A shaving system of the wet shave type includes body structure with guard surface structure at a front portion thereof and opposed portions forming a gap at a rear portion thereof. Blade structure is carried by the body structure rearwardly of the guard surface structure and forwardly of the gap and has a cutting edge extending along the length of the body structure. A shaving aid member is carried on the support structure behind the blade structure, the shaving aid member having a dispensing head portion with a skin-engaging surface, a narrow neck region within the gap, and a retaining portion on the side of the narrow neck region opposite the head portion. The retaining portion has a larger dimension than the width of the gap, and the dispensing head portion is at least twice in cross-sectional area as large as the retaining portion.

15 Claims, 1 Drawing Sheet

SHAVING SYSTEM

This invention relates to shaving systems, and more particularly to shaving systems of the wet shave type.

A shaving of the wet shave type includes at least one blade structure and a surface for engaging the user's skin adjacent the blade edge or edges. Typically, the shaving system includes a leading skin-engaging surface (forward of the cutting edge of the blade structure) and a trailing skin-engaging surface (rearwardly of the blade unit structure). The leading skin-engaging surface may be referred to as a guard surface and the trailing skin-engaging surface may be referred to as a cap surface. The skin-engaging surface(s) cooperates with the blade edge or edges and has one or more functions such as definition of shaving geometry, tensioning of skin in the region to be shaved, and/or delivery of shaving aid material to the skin surface during the shaving stroke. The shaving system may be of the disposable cartridge type adapted for coupling to and uncoupling from a razor handle or may be integral with a handle so that the complete razor is discarded as a unit when the blade or blades become dulled.

In accordance with one aspect of the invention, there is provided a shaving system of the wet shave type that includes body structure with guard surface structure at a front portion thereof and opposed portions forming a gap at a rear portion thereof. Blade structure is carried by the body structure rearwardly of the guard surface structure and forwardly of the gap and has a cutting edge extending along the length of the body structure. A shaving aid member is carried on the support structure behind the blade structure, the shaving aid member having a dispensing head portion with a skin-engaging surface, a narrow neck region within the gap, and a retaining portion on the side of the narrow neck region opposite the head portion. The retaining portion has a larger dimension than the width of the gap, and the dispensing head portion is at least twice in cross-sectional area as large as the retaining portion.

In preferred embodiments, the shaving aid member further includes an extension portion that increases in width along a first axis passing through the narrow neck region and the retaining portion, the head portion having a dimension along an axis perpendicular to the first axis that is more than twice as long as the widest part of the retaining portion; and the length of the extension portion along the first axis is greater than the widest part of the retaining portion along an axis perpendicular to the first axis.

In particular embodiments, the shaving system includes movable sheet metal guard structure carried by the body structure adjacent the cutting edge of the blade structure, and positioned for dynamic movement against biasing structure in the course of a shaving stroke; and two blade structures are mounted on the body structure for resilient movement as biased by integral, resilient fingers.

In a particular embodiment, the movable guard structure is positioned about one millimeter rearwardly of the front surface of the body, the cutting edge of the first blade structure is positioned about three millimeters rearwardly of the front body surface; the cutting edge of the second blade structure is positioned about four millimeters rearwardly of the front body surface; the leading edge of the shaving aid member is positioned about six millimeters rearwardly of the front body surface; and the rear edge of the shaving aid member is positioned about eight millimeters rearwardly of the front body surface. The shaving aid member is extrusion-oriented and includes a mixture of hydrophobic polymeric material and water soluble polymeric material which is capable of forming an aqueous lubricant, and its skin-engaging surface is curved at a radius of at least three millimeters.

Other features and advantages will be seen as the following description of a particular embodiment progresses in conjunction with the drawings in which.

DESCRIPTION OF PARTICULAR EMBODIMENT

Figure 1:
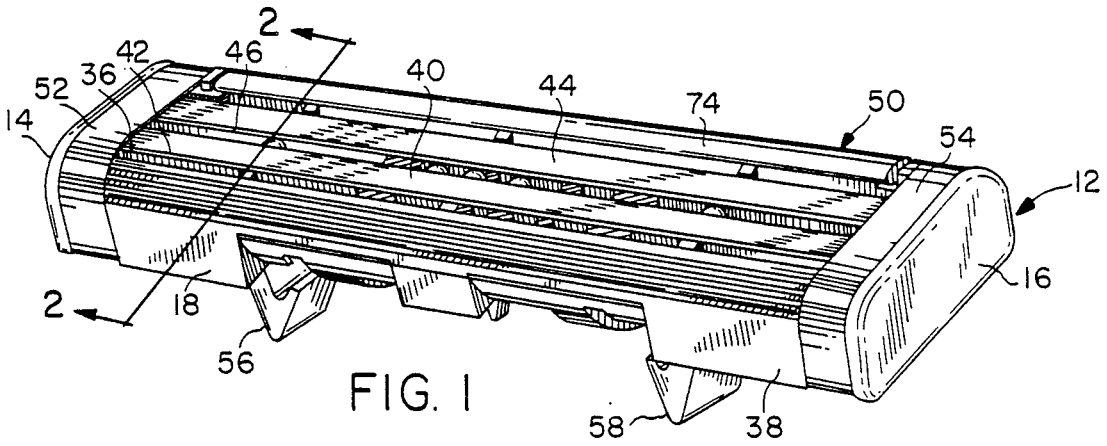
FIG. 1 is a perspective view of a shaving system in accordance with the invention.
Figure 2:
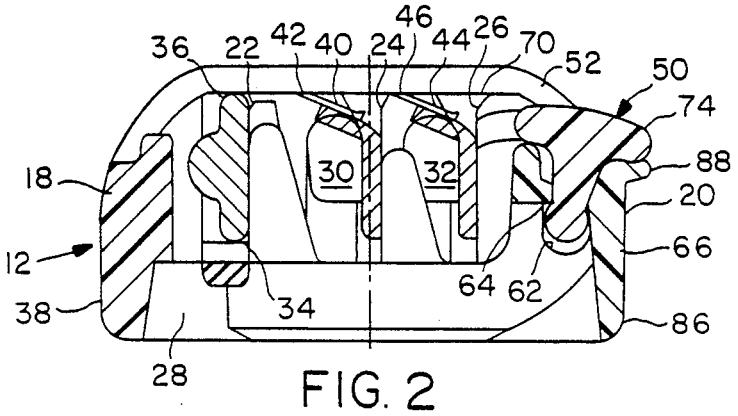
FIG. 2 is a sectional view of the shaving system of FIG. 1 taken along the line 2—2 of FIG. 1.
Figure 3:
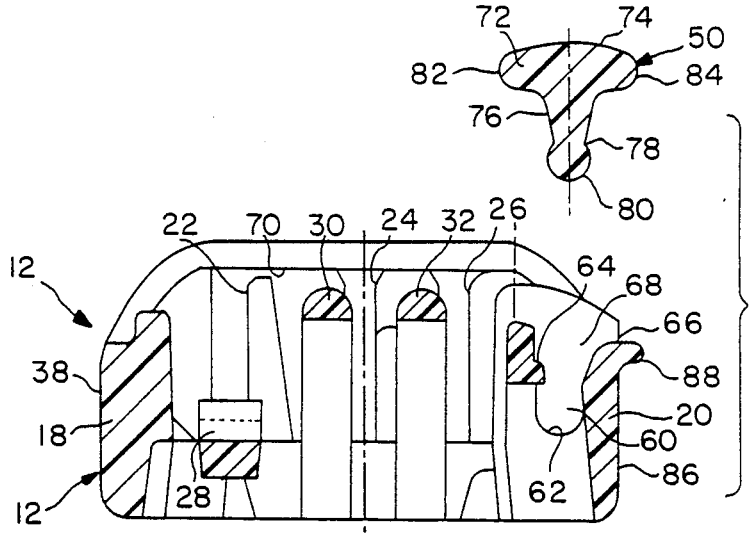
FIG. 3 is an exploded sectional view taken along the same line as FIG. 2 of the body member and of the shaving aid member incorporated in the shaving system of FIG. 1.

The shaving system 10 shown in FIGS. 1 and 2 is of the type shown in Jacobson U.S. Pat. No. 4,586,255 (the disclosure of which is expressly incorporated herein by reference). Cartridge 10 has a width of about eight millimeters, a height of about four millimeters, and a length of about four centimeters, and includes body member 12 of molded polymeric material that has end portions 14, 16 interconnecting front and rear portions 18, 20. As indicated in FIGS. 2 and 3, formed rearwardly of front portion 18 in each end portion are slots 22, 24, 26, each of which has associated with it a pair of biasing spring fingers 28, 30, 32, respectively. Movable sheet metal guard member 34 has guard surface 36 of about 0.5 millimeter width and tab portions that are disposed in slots 22 so that it is located about two millimeters rearwardly of the front surface 38 of front portion 18; movable leading blade unit 40 has its guide portions received in opposed slots 24 so that its cutting edge 42 is positioned about 2.7 millimeters rearwardly of front surface 38 of portion 18; trailing blade member 44 is received in slots 26 so that its cutting edge 46 is positioned about 4.3 millimeters rearwardly of front surface 38; and member 50 of shaving aid material is carried by rear frame portion 20. The guard member 34 and the two blade units 40, 44 are biased upwardly against retaining clips 52, 54 by biasing spring fingers 28, 30, 32, respectively into alignment with surface 70. Assembly 10 also includes depending extensions 56, 58 each of which includes an arcuate rail surface that engages in pivotal attachment to a razor handle (not shown).

Formed in rear frame portion 20 is recess 60 defined by curved base surface 62 (about 0.4 millimeter radius whose center is located about 2.5 millimeters below upper surface 70; and projections 64, 66 that define a gap 68 of about 0.6 millimeter width.

Disposed in recess 60 is insert member 50 that is formed of an extruded mixture of water insoluble matrix material (polystyrene) and water-leachable polymeric shaving aid material (polyethylene oxide). Insert member 50 has a length of about three centimeters, a head portion 72 that has outer surface 74 curved at a radius of about four millimeters of about 2.3 millimeters arcuate length, and a depth of about 0.6 millimeter; an extension portion 76 that tapers from a width of about 0.8 millimeter at head portion 72 to neck region 78 that has a width of about 0.5 millimeter; and cylindrical retaining portion 80 that has a diameter of about 0.7 millimeter. Insert member 50 is mechanically retained in recess 60 by engagement of portions 64, 66 with neck region 78 of insert member 50 as indicated in FIG. 2. In that position, the leading surface 82 of the skin-engaging head portion 72 is spaced slightly less than two millimeters rearwardly of the cutting edge 42 of trailing blade unit 40 and its trailing surface 84 extends slightly beyond the rear surface 86 of rear portion 20 and overlies support lip 88 as indicated in FIG. 2.

The leading surface of movable guard 34 is positioned about 1.5 millimeters rearwardly of the front surface 38 of cartridge 10; the cutting edge 42 of leading blade unit 40 is positioned about 2.7 millimeters from the front surface 38 of the cartridge; the cutting edge 46 of the trailing blade unit 44 is positioned about 4.3 millimeters from the cartridge front surface 38; the leading edge 82 of shaving aid member 50 is positioned about 5.9 millimeters from the cartridge front surface 38; and the rear edge 84 of insert member 50 extends about 0.1 millimeter beyond the rear main surface 86 of the cartridge (about 8.1 millimeters from front surface 38). Thus, the skin-engaging surface of the shaving member has a width dimension that is over twenty-five percent of the overall width of the cartridge, and is fixed in place and does not interfere with the resilient movement of the guard 34 or either blade unit 40 or 44. The shaving aid member 50 is mechanically secured in reliable manner without necessity for use of an adhesive material. The shaving aid member shape is such that over half of its entire volume is in the head portion 72. The cross-sectional area of head 72 is about 1.3 square millimeters, the cylindrical latch knob 80 has a cross-sectional area of about 0.4 square millimeters, and the tapered coupling portion 76 has a cross-sectional area of about 0.6 square millimeter. The configuration enhances the delivery surface area and volume of shaving-aid material and provides a sturdy shaving aid insert member 50 that is reliably secured mechanically to the cartridge body 12.

The shaving aid member 50 has a relatively large skin-engaging surface 74 at its head 72 with a tapered extension portion 76 such that a delivery of the leachable polyethylene oxide shaving aid material from the body of the shaving member 70 is facilitated. Further the shaving aid member 50 is of sturdy cross-sectional configuration with a relatively small volume securing cylinder 80 so that release of the water-leachable shaving aid material as a function of the physical configuration of insert member 50 is facilitated.

In use, the cartridge 10 is attached to a handle for shaving. During shaving, the movable guard member 34 and blade units 40 and 44 move independently of each other against the bias of the spring fingers 28, 30, 32 as the blade assembly 10 is moved across the user's skin in a shaving stroke with shaving aid material being dispensed from insert member 50 during the course of each shaving stroke. During each shaving stroke, the blade assembly 10 pivots as a whole on the handle, following the contours of the skin surface being shaved.

While a particular embodiment has been shown and described, various modifications will be apparent to those skilled in the art and therefore it is not intended that the invention be limited to the disclosed embodiments and details may be made therefrom within the spirit and scope of the invention.

What is claimed is:

1. A shaving system comprising body structure, said body structure having guard surface structure at a front portion thereof and opposed portions forming a gap at a rear portion thereof, blade structure carried by said body structure rearwardly of said guard surface structure and forwardly of said gap, said blade structure having a cutting edge extending along the length of said body structure, and a shaving aid member carried on said support structure behind said blade structure, said member having a dispensing head portion with a skin-engaging surface, an extension portion, a narrow neck region within said gap, and a retaining portion on the side of said narrow neck region opposite said head portion, said retaining portion having a larger dimension than the width of said gap, said extension portion increasing in width along a first axis passing through said narrow neck region and said retaining portion, and said dispensing head portion having a dimension along an axis perpendicular to said first axis more than twice as long as the widest part of said retaining portion.

2. The shaving system of claim 1 wherein said head portion has a width dimension along an axis perpendicular to said first axis that is more than three times as long as the widest part of said retaining portion.

3. The shaving system of claim 1 wherein said length of said extension portion along said first axis is greater than the distance of the widest part of said retaining portion along an axis perpendicular to said first axis.

4. The shaving system of claim 3 wherein said support structure supports said extension portion along a majority of the rear surface of said extension portion.

5. The shaving system of claim 1 wherein said width dimension of said head portion is greater than two millimeters.

6. The shaving system of claim 1 wherein said extension portion increases in width perpendicular to said first axis at an angle of at least 15°.

7. The shaving system of claim 2 wherein said skin-engaging surface of said head portion is curved at a radius of at least three millimeters.

8. The shaving system of claim 2 wherein said shaving aid member includes a mixture of hydrophobic polymeric material and water soluble polymeric material which is capable of forming an aqueous lubricant.

9. A shaving system comprising body structure, said body structure having guard surface structures at a front portion thereof and opposed portions forming a gap at a rear portion thereof, a blade structure carried by said body structure rearwardly of said guard surface structure and forwardly of said gap, said blade structure having a cutting edge extending along the length of said body structure, movable guard structure carried by said body structure adjacent said cutting edge of said blade structure, said body structure having integral guide structure and integral biasing structure, said movable guard structure having integral guide portions disposed in said guide structure and being positioned in engagement with said biasing structure for dynamic movement of said movable guard structure against said biasing structure as guided by said guide structure in the course of a shaving stroke, and a shaving aid member carried on said support structure behind said blade structure, said member having a dispensing head portion with a skin-engaging surface, a narrow neck region within said gap, and a retaining portion on the side of said narrow neck region opposite said head portion, said retaining portion having a larger dimension than the width of said gap, and said dispensing head portion being at least twice as large in cross-sectional area as said retaining portion.

10. The shaving system of claim 9 wherein said movable guard structure includes a sheet metal member, said integral guide portions are tab portions of said sheet metal member, and said guide structure in said body structure includes opposed slots in which said tab portions are disposed for guiding movement of said guard structure along a predetermined path.

11. The shaving system of claim 9 wherein said blade structure is mounted for resilient movement with respect to said body structure.

12. The shaving system of claim 11 further including second blade structure mounted on said body structure for resilient movement with respect to said body structure, and said biasing structure includes integral, resilient fingers that resiliently bias said guard structure and said blade structures.

13. The shaving system of claim 12 wherein said movable guard structure is positioned about two millimeters rearwardly of the front surface of said front portion, the cutting edge of said first blade structure is positioned about three millimeters rearwardly of the front surface of said front portion; the cutting edge of said second blade structure is positioned about four millimeters rearwardly of the front surface of said front portion; the leading edge of said shaving aid member is positioned about six millimeters rearwardly of the front surface of said front portion; and the rear edge of said shaving aid member is positioned about eight millimeters rearwardly of the front surface of said front portion.

14. The shaving system of claim 13 wherein said shaving aid member further includes an extension portion, said extension portion increasing in width along a first axis passing through said narrow neck region and said retaining portion, said head portion having a dimension along an axis perpendicular to said first axis more than three times as long as the widest part of said retaining portion.

15. The shaving system of claim 14 wherein said shaving aid member includes a mixture of hydrophobic polymeric material and water soluble polymeric material which is capable of forming an aqueous lubricant.

* * * * *